US005184961A

United States Patent [19]

Ramirez et al.

[11] Patent Number: 5,184,961

[45] Date of Patent: Feb. 9, 1993

[54] MODULAR CONNECTOR FRAME

[75] Inventors: Fernando J. Ramirez, Fountain Valley, Calif.; Rocco J. Noschese, Wilton, Conn.; Barry A. Holmes, San Mateo; Thomas L. Hannigan, Los Gatos, both of Calif.

[73] Assignee: Burndy Corporation, Norwalk, Conn.

[21] Appl. No.: 718,130

[22] Filed: Jun. 20, 1991

[51] Int. Cl.[5] ..... H01R 23/70

[52] U.S. Cl. ..... 439/59; 439/248; 439/328; 439/377; 439/532; 439/540; 439/924

[58] Field of Search ..... 439/55, 59-62, 439/64, 79, 80, 247, 248, 554, 532, 540, 924, 328, 377

[56] References Cited

U.S. PATENT DOCUMENTS

| | | | |
|---|---|---|---|
| 3,486,077 | 12/1969 | Oeler et al. | 439/554 |
| 3,601,770 | 8/1971 | Bowley | 339/125 |
| 3,954,318 | 5/1976 | Larson et al. | 439/248 |
| 4,179,172 | 12/1979 | Godsey et al. | 439/61 |
| 4,550,959 | 11/1985 | Grabbe et al. | 339/9 |
| 4,582,375 | 4/1986 | Keller | 439/59 |
| 4,655,518 | 4/1987 | Johnson et al. | 339/17 |
| 4,687,276 | 8/1987 | Stockmaster | 439/557 |
| 4,906,197 | 3/1990 | Noll | 439/79 |
| 4,944,586 | 7/1990 | Danbach et al. | 439/248 |
| 4,996,766 | 3/1991 | Piorunneck et al. | 29/842 |

OTHER PUBLICATIONS

IBM Bulletin, Mechanical Strain Relief On A Surface Mounted Connector, vol. 29, No. 8, p. 3631, Jan. 1987.

*Primary Examiner*—Neil Abrams
*Attorney, Agent, or Firm*—Perman & Green

[57] ABSTRACT

A combined electrical connector and connector nesting assembly has a frame with a first section adapted to receive an edge of a printed circuit board and a second section adapted to receive a connector of a cable assembly. The first section has a card edge receiving slot and spring contacts can be inserted thereinto. The second section is located parallel to, but offset from the first section such that when a printed circuit board is inserted into the assembly, a connector located in the second section can receive contact pins projecting from the printed circuit board. The assembly frame can be snap-locked into an electronic component chassis and the connector can be snap-locked into the second section of the frame.

14 Claims, 2 Drawing Sheets

10
12
14
16
18
20
22
24
26
28
30
32
34
36
38
40
42
44
46
48
50
52
54
56
58
60
62
64
66
68
108
110
114
116
122
128
130
132
134
136
138
140

MODULAR CONNECTOR FRAME

BACKGROUND OF THE INVENTION

1. Field of the Invention

The present invention relates to electrical connectors and, more particularly, to a combined card edge connector and connector nesting frame and a method of assembling an electrical connector assembly in an electronic component.

2. Prior Art

U.S. Pat. No. 4,996,766 to Piorunneck et al. discloses a bi-level card edge connector used to connect a daughter printed circuit board to a mother printed circuit board. U.S. Pat. No. 4,550,959 to Grabbe et al. discloses a card edge connector with a modular housing. U.S. Pat. No. 3,601,770 to Bowley discloses arms that are snapped onto a connector body. U.S. Pat. No. 4,655,518 to Johnson et al. discloses a backplane connector with pins connected to a daughter board.

One particular type of electrical connector used in the prior art is used to connect a printed circuit board to various electronic components in a computer such as a hard disk drive, another printed circuit board, a floppy disk drive, etc. This particular type of connector has card edge receiving areas for receiving portions of an edge of the printed circuit board and, pin receiving contacts for receiving portions of contact pins connected to the printed circuit board at the same end of the board having portions inserted into the card edge receiving areas.

A problem exists with this prior art combined card edge and card contact pin connector in that, because of the numerous and awkward electrical wires and ribbon cables between the power source, the electrical connector, and electronic components, it is time consuming and difficult to connect the electrical connector to the chassis of the computer and, to connect the electrical wires and ribbon cable to the electrical connector. This awkwardness and difficulty is even more pronounced in the smaller size computers being manufactured today. This problem is even more pronounced where the computer has the printed circuit board and electrical connector located in a bottom portion of the computer with a chassis shelf between the printed circuit board and the other electronic components, once again establishing a limited amount of work space.

It is therefore an objective of the present invention to provide a new and improved electrical connector that can overcome problems in the prior art as well as provide additional features.

SUMMARY OF THE INVENTION

The foregoing problems are overcome and other advantages are provided by a combined electrical connector and connector nesting assembly housing and, a method of assembling an electrical connector assembly to an electronic component.

In accordance with one embodiment of the present invention, a combined electrical connector and connector nesting housing is provided comprising a frame, means for connecting electrical contacts to the frame, means for connecting a first connector of a flexible circuit assembly to the frame, and means for connecting a first end of a printed circuit board to the contacts and connector connected to the frame. The frame has a first section, a second section, and means for connecting the frame to an electrical component chassis. The means for connecting electrical contacts to the frame is located at the first section. The means for connecting a first connector to the frame is located at the second section. The means for connecting a first end of the printed circuit board can connect the first end to the electrical contacts in the first section and to the first connector at the second section such that the contacts and connector can be connected to the frame after the frame is connected to the electrical component chassis, but the first end of the printed circuit board can be substantially simultaneously connected to both the contacts and the connector as the card is inserted into the electrical component.

In accordance with another embodiment of the present invention an electrical connector assembly housing is provided comprising a frame, means for mounting a plurality of contacts to the frame, means for mounting a plurality of connectors to the frame, and means for mounting the frame to an electrical component chassis. The means for mounting a plurality of contacts can mount the contacts along a first linear axis of the frame. The means for mounting a plurality of connectors to the frame can mount the connectors along a second linear axis parallel to the first linear axis. The means for mounting the connectors is adapted to connect the connectors to the frame spaced from, but aligned with the contacts to face the same direction as the contacts, and comprises a first snap lock connection system. The means for mounting the frame to the electrical component chassis comprises a second snap-lock connecting system.

In accordance with another embodiment of the present invention, an electrical connector nesting frame is provided comprising means for snap-lock mounting the frame to an electrical component chassis, and means for snap-lock mounting a connector of a flexible circuit assembly to the frame. The means for mounting the connector comprises means for allowing limited lateral movement of the connector relative to the frame.

In accordance with one method of the present invention, a method of assembling an electrical connector assembly in an electronic component is provided comprising steps of providing an elongate modular connector nesting frame; connecting the frame to a chassis of the electronic component, the step of connecting comprising a snap-lock connection of the frame to the electronic component; and connecting first connectors of at least two flexible circuit assemblies to the frame. The step of connecting first connectors comprises snap-lock connections of the connectors to the frame at different locations along the frame such that the frame can be connected to the chassis and the flexible circuit assemblies can then be connected to the frame to allow easier connection of the frame and assemblies as a stepped process.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
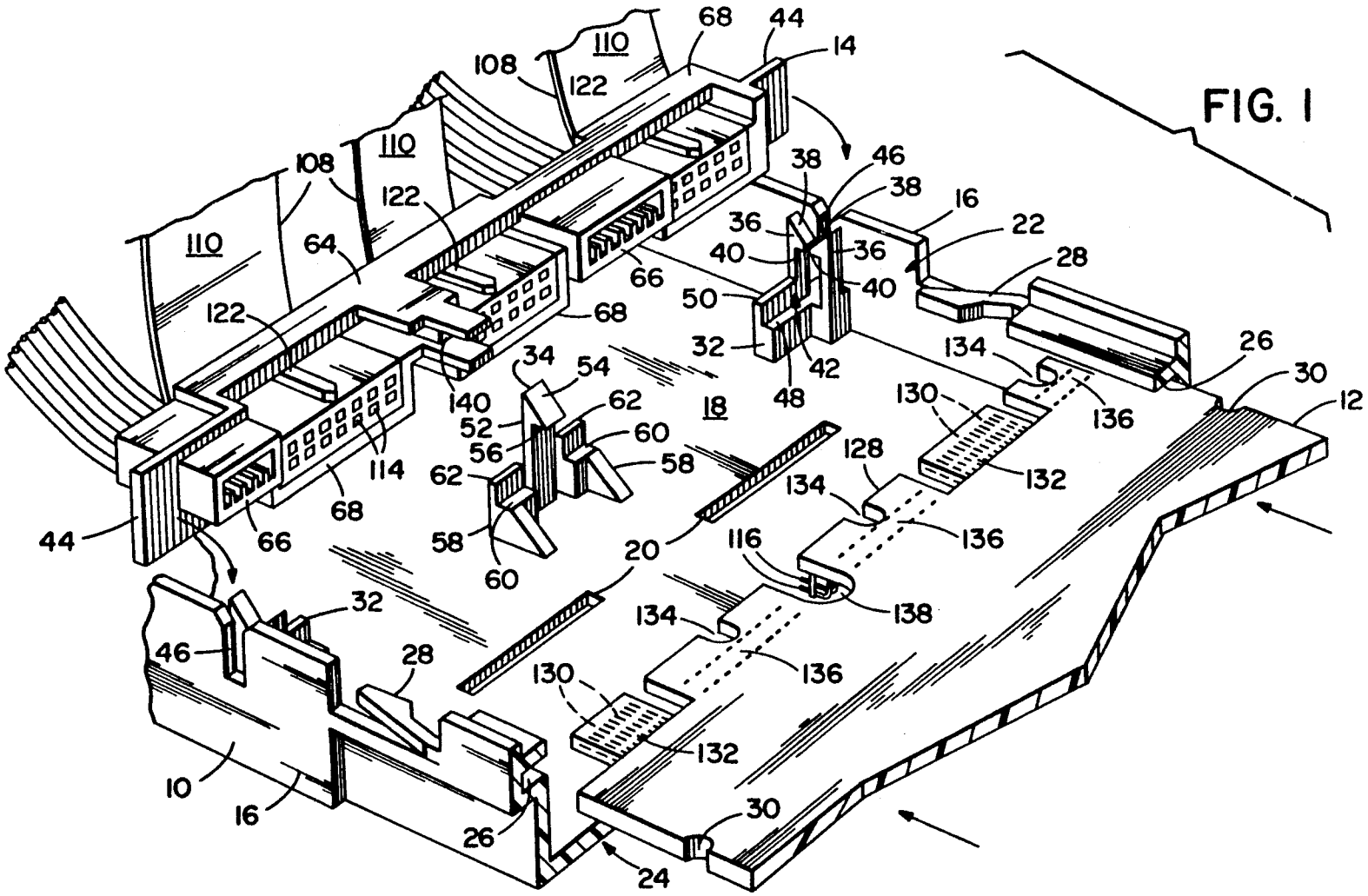
FIG. 1 is a partial exploded perspective view of a bottom of a component chassis, an end of a printed circuit board, and an electrical connector incorporating features of the present invention.
Figure 2:
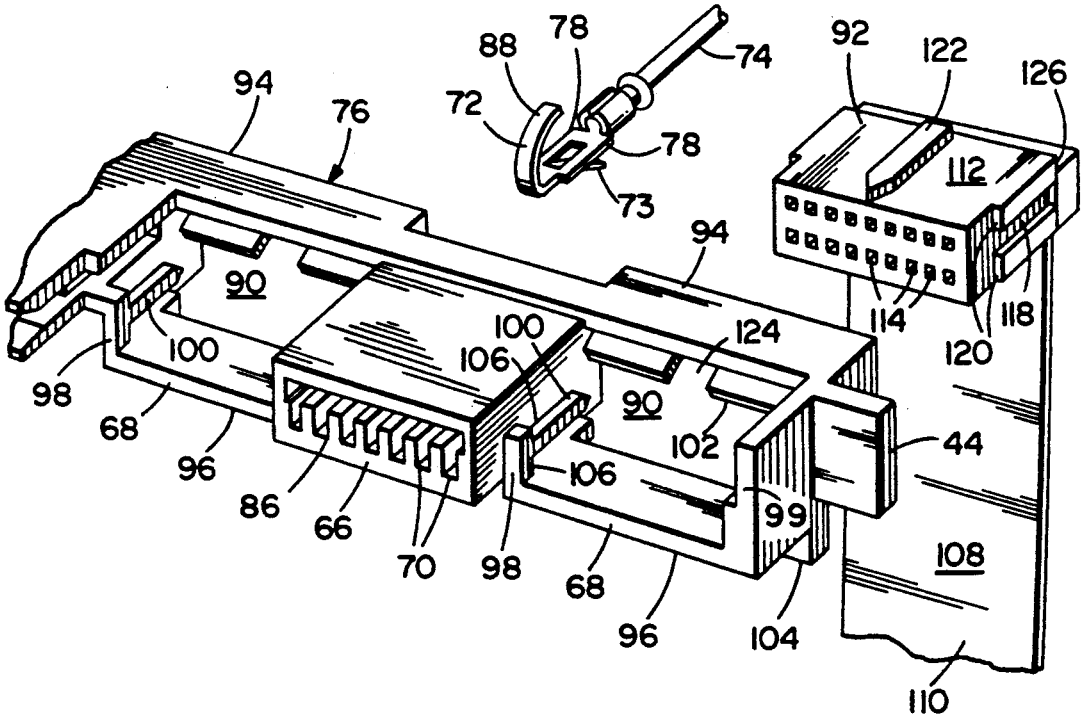
FIG. 2 is a partial exploded perspective view of one end of the connector shown in FIG. 1.
Figure 3:
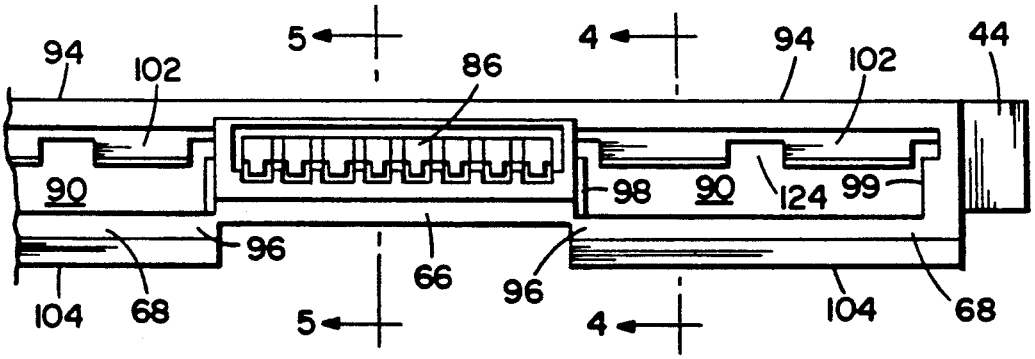
FIG. 3 is a partial plan front view of the frame of the electrical connector shown in FIG. 1.
Figure 4:
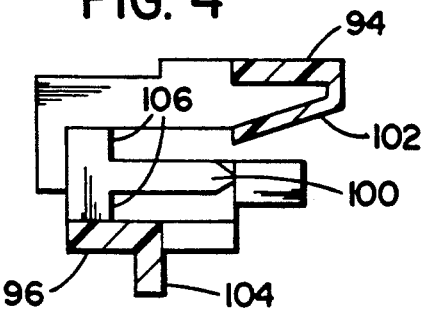
FIG. 4 is a cross sectional view of the frame shown in FIG. 3 taken along line 4—4.
Figure 5:
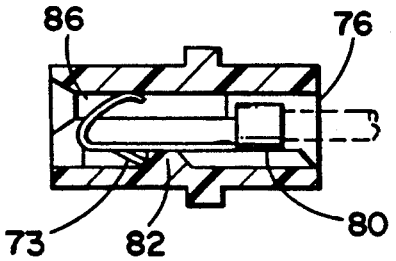
FIG. 5 is a cross sectional view of the frame shown in FIG. 3 taken along line 5—5.

Referring now to FIG. 1, there is shown a partial exploded perspective bottom view of an electrical or electronic component chassis 10, an end of a printed circuit board 12, and an electrical connector 14 incorporating features of the present invention. Although the present invention will be described with reference to the embodiment shown in the drawings, the present invention can be incorporated into various different types of embodiments. In addition, any suitable size, shape or type of elements or materials can be used to practice the claimed invention.

In the embodiment shown in FIG. 1, the chassis 10 is for a computer. However, the present invention can be used in any suitable type of electrical or electronic device. The chassis 10 has side walls 16 and a shelf or divider 18 between the side walls 16. The shelf 18 has apertures 20 therethrough such that electrical cables 110 can pass from the bottom area 22 of the chassis 10 to the top area 24 of the chassis 10 (note once again that FIG. 1 is a bottom view). The chassis 10, in the embodiment shown, has grooves 26 in its sides 16 which are adapted to hold sides of the printed circuit board 12 therein and, are adapted to allow the board 12 to slidably move in the grooves 26. The chassis 10 has a suitable door (not shown) in the rear of the computer that can be opened to insert the board 12 into the bottom area 22 of the chassis 19. Of course, any suitable means could be provided to allow access to the bottom area 22. Located at the ends of the grooves 26, in the embodiment shown, are printed circuit board position locking clips 28. The locking clips 28 may be integrally formed with the chassis 10 or may be fixedly connected thereto. The locking clips 28 project into the bottom area 22 as cantilevered arms in the path of the grooves 26. The clips 28 are resiliently outwardly deformable. While a printed circuit board is being inserted into the computer, the clips 28 must be pushed out of the path of the front of the side edges of the board 12 in order for the board to be able to reach its final connection position with respect to the electrical connector 14. Once the board 12 does reach its final connection position, the clips 28 snap into side recesses 30 in the board 12 to prevent the board from moving which might otherwise cause an inadvertent disconnection of the board 12 from the electrical connector 14. In the embodiment shown, the chassis 10 also comprises connector mounts 32 and 34 for connecting the connector 14 to the chassis 10. The connector mounts 32 and 34 can be integrally formed with the chassis 10 or can be connected thereto. The side mounts 32 generally comprise two cantilever arms 36 having sloped surfaces 38 for guiding a portion of the connector 14 therebetween, and flat surfaces 40. The side mounts 32 form a space 42 between their two arms 36 adapted to hold side portions 44 of the connector 14 therein. The chassis 10 also has notches 46 in its sides 16 at the sides of the connector mounts 32 for receiving the ends of the connector side portions 44. In addition, the side connector mounts 32 have a shelf 48 for the side portions 44 to be positioned against and a back support 50.

The other connector mount 34, in the embodiment shown, is located between the two sides 16 and has a cantilevered arm 52 with a head having a shaped surface 54 and a flat surface 56 and, two supports 58 with shelves 60 and back supports 62. The arms 36 and 52 are comprised of resiliently deformable material such that the arms 36 and 52 can deflect to allow connection of the connector 14 therewith as further described below. However, any suitable means could be used to connect the connector 14 to the chassis 10.

Referring now also to FIGS. 2–5, the electrical connector 14 will be further described. In the embodiment shown, the connection 14 generally comprises a frame 64 having first sections 66 and second sections 68. However, any suitable member and type of sections could be provided. The frame 64 is preferably comprised of a dielectric material and is provided as a single unitary member such as an injection molded thermoplastic member. The first sections 66 have channels 70 therethrough for receiving spring contacts 72. The contacts 72 are connected to electrical wires 74 which are preferably connected to a power supply. The contacts 72 can be inserted through the back 76 of the frame 64 with their sides 78 siding in slots 80. The contacts 72 have a projecting latch portion 73 that snaps over the latch portion 82 to lock the contact 72 to the frame 64. Each of the first sections 66 also has a card edge receiving slot 86. The contact portions 88 of the contacts 72 project into the slots 86.

The second sections 68, in the embodiment shown, generally establish a connector receiving area 90 for receiving electrical connectors 92. Thus, the frame 64 provides two functions. The frame 64 functions as a housing for the electrical contacts 72 and, the frame 64 functions as a nesting frame for connecting electrical connectors 92 thereto. In the embodiment shown, the second sections 68 each comprise two beams 94 and 96 with side portions 98 and 99 that substantially define the receiving area 90. The second sections 68 also comprise alignment ribs 100 extending into the receiving area 90 from the side portions 98 and 99 and, a snap-lock portion 102 extending from the first beam 94. The second beam 96 also has a leg 104 intended to rest upon the chassis shelf 18 or slightly spaced therefrom. The primary purpose of the leg 104 is to give the beam 96 stiffness. The snap-lock portion 102 is resiliently deformable in order to allow the connector 92 to be pushed into the receiving area 90 and snap back to a position behind the connector 92 to lock the connector 92 into the receiving area 90. The side portions 98 and 99 also comprise stop ledges 106 to stop the forward insertion of the connector 92 at a predetermined position.

The connector 14, in the embodiment shown, is intended to be used as a nesting frame for connecting one end of flexible circuit assemblies 108 thereto. The flexible circuit assemblies 108 are each generally comprised of a first electrical connector 92, a flex circuit or ribbon cable 110, and a second electrical connector (not shown) at the other end of the ribbon cable 110. The assemblies 108 are intended to transmit signals between the printed circuit board 12 and the other computer electronics. Because the other computer electronics are located on the opposite side of the shelf 18 than the printed circuit board 12, the ribbon cables 110 are suitably sized and shaped to pass through the shelf apertures 20. In a preferred embodiment, the connectors 92 are insulation displacement connectors (IDC) adapted to pierce through the outer insulation of the cables 110 and have their contacts (not shown) make electrical contact with the conductors in the cables 110 when connected thereto.

The connectors 92 generally comprise a housing 112 with pin receiving apertures 114 and a plurality of pin receiving contacts (not shown) located in the housing 112 for making contact with pins 116 when inserted into the apertures 114. The connectors 92 are intended to be inserted into the frame 64 and snap-locked into a position therewith by inserting the connectors 92 through the back 76 of the frame 64. The connector housings 112 have side channels 118, stops 120, and a polarizing rib 122. The side channels 118 are adapted to receive the frame alignment ribs 100 therein. The stops 120 are adapted to make contact with the stop ledges 106 to stop forward advancement of the connector 92 into the frame 64. The primary purpose of the rib 122 is to align with notches 134 in the board 12 to assure proper alignment of pins 116 into the connector openings 114. The polarizing rib 122 is also generally intended to prevent insertion of the connector 92 into the frame 64 in an upside-down orientation. The snap-lock portion 102 has a notch 124 to allow the rib 122 to pass therethrough. If a person attempted to connect the connector 92 to the frame 64 in the incorrect upside-down orientation, the rib 122 would hit the second beam 96 and thereby prevent full insertion. As the connector 92 is inserted into the receiving area 90 the snap-lock portion 102 is deformed or depressed by the top of the connector 92 until the back stop 126 of the connector passes the front of the snap-lock portion 102. The snap-lock portion 102 for each area 90 substantially snaps back to its undeformed position behind the back stop 126 thereby connecting the connector 92 to the frame 64 and preventing inadvertent disconnection of the connector 92 from the frame 64. One of the unique aspects of the capture of the connectors 92 in the frame 64 is that the capture is not a totally stationary capture. The connectors are limited in movement in all directions except lateral movement or movement along the longitudinal axis of the frame. This is provided such when the board 12 is being inserted into the connector 14, the connectors 92 can move slightly to properly align the openings 114 with the pins 116 as the ribs 122 align with notches 134. Thus, a floating type of mounting system is provided. Of course, the connectors 92 need not be float mounted or, may be float mounted in additional or alternative paths of movement.

The frame 64, in the embodiment shown, is adapted to receive portions of the printed circuit board 12 in the card edge receiving slots 86 of the first sections 66 and, to have other portions of the board 12 positioned in the second sections 68 over the connectors 92. As seen in FIG. 1, the printed circuit board 12 has an edge 128 intended to be connected to the connector 14. The edge 128, in the embodiment shown, includes contact pads 130 at first sections 132 and contact pins 116 at second sections 136. The second sections 136 also comprise notches 134 to accommodate polarizing ribs 122. The edge 128 also comprises a notch 138 adapted to accommodate polarizing stop 140 on the frame 64 of the connector 14. Due to the offset nature of the polarizing stop 140 relative to the center of the longitudinal length of the frame 64 of the connector 14, a person inserting the printed circuit board 12 is prevented from connecting the printed circuit board 12 to the connector 12 in an upside-down orientation. The polarizing stop 140 and polarizing notch 138 must be aligned before the board 12 can be connected to the connector 14. The polarizing stop 140, in addition to its polarizing function, also performs an aligning function to align the contact pads 130 on the card 12 with the spring contacts 72 in the frame 64. The card slots 86 are generally aligned along a first axis and the connector receiving areas 90 are generally aligned along a second axes parallel to the first axis. Thus, when the edge 128 of the board 12 makes contact with the connector 14, the first sections 132 are received in the card edge receiving areas 86 and the second sections 136 are located adjacent to the connectors 92.

One of the principal problems that the present invention addresses is the difficulty in connecting so many electrical wires and cables is such a small or tight area. The present invention overcomes this problem due to its modular connecting system. During assembly of the computer, an assembler will first connect the connectors 92 to the ribbon cables 110. The ribbon cables 110 can either already be positioned through the chassis apertures 20 or can be inserted through the apertures 20 and have the other connector (not shown) connected thereto. The assembler can then connect the frame 64 to the chassis 10. In the embodiment shown, the assembler will locate the connectors 92 behind the connector mounts 32 and 34 while the frame 64 is being mounted such that the cables 110 are located between the chassis shelf 18 and frame 64 to take up the least amount of space and not interfere with the insertion of the board 12 into the connector 14. Of course, the cables 110 need not be located between the frame 64 and shelf 18 and, the connectors 92 can be assembled with the frame either before or after the frame 64 is connected to the chassis 10.

In order to connect the frame 64 to the chassis 10, the assembler aligns the frame 64 with the mounts 32 and 34 and notches 46 and, presses the frame 64 in. As the frame 64 is pressed in, the frame 64 uses the sloped surfaces 38 of the side mount arms 36 to deflect or wedge the arms 36 apart. This allows the side portions 44 of the frame 64 to pass between the heads of the arms 36 and be positioned in the spaces 42 of the side mounts 32 and into the notches 46. The heads of the arms 36 are then able to snap back to their undeflected positions effectually capturing the side portions 44 in the spaces 42. The middle mount 34 behaves in a similar fashion in that the frame deflects the arm 52 which snaps back to capture the frame 64 between the flat surface 56 and the shelves 60 of the supports 58. The back supports 50 and 62 add support to the connector 14 to keep it in place while the board 12 is being inserted.

With the frame 64 connected to the chassis 10, the assembler then merely inserts the individual connectors 92 of the assemblies 108 into the receiving areas 90. Once again, similar to the connection of the frame 63 to the mounts 32 and 34, the connection of the connectors 92 to the frame 64 merely comprises insertion of the connectors 92 into the receiving areas 90 with the snap-lock portions 102 snap-lock connecting the connectors 92 to the frame. The assembler can also insert and mount the contacts 72 into the frame 64 which also are snap-locked into the first sections 66 via the holes 84 and latch portions 82. Of course, connection of the connectors 92 and contacts 72 to the frame 64 can be done either before or after the frame 64 is connected to the chassis 10. The assembly of the connector 14 and the connection of the connector 14 to the chassis is thus complete. In regard to the connection of the board 12 to the connector 14, this can either be done at the factory by the assembler or, the board 12 can be left out of the computer and the purchaser of the computer can buy and insert the board 12 to modify or upgrade the computer.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A combined electrical connector and connector nesting housing comprising:

a frame having a first section, a second section, and means for connecting the frame to an electrical component chassis;

means for connecting electrical contacts to the frame at the first section;

means for connecting a first connector of a flexible circuit assembly to the frame at the second section, the means for connecting the first connector comprising the frame having a receiving hole with side ribs adapted to be received in side notches of the first connector and a cantilevered spring latch adapted to project behind a portion of the first connector; and means for connecting a first end of a printed circuit board to the electrical contacts in the first section and to the first connector of the flexible circuit assembly and the second section such that the contacts and connector can be connected to the frame after the frame is connected to the electrical component chassis, but the first end of the printed circuit board can be substantially simultaneously connected to both the contacts and the connector as the card is inserted into the electrical component.

2. A housing as in claim 1 wherein the first section is adapted to receive electrical contacts comprising spring contacts adapted to make electrical contact with conductive traces on an edge of the printed circuit board first end.

3. A housing as in claim 1 wherein the means for connecting the first connector to the frame includes means for allowing limited lateral movement of the first connector relative to the frame.

4. A housing as in claim 1 wherein the means for connecting the frame to an electrical component chassis includes means for snap-locking the frame to the chassis.

5. A housing as in claim 1 wherein the frame first section has a slot for receiving a portion of an edge of the printed circuit board first end along a first axis and, the frame second section being adapted to receive the first connector along a second axis parallel to the first axis.

6. A housing as in claim 1 wherein the frame has a plurality of first and second sections.

7. An electrical connector assembly housing comprising:

a unitary frame, the frame having a receiving area for receiving a portion of an edge of a printed circuit board in the frame along a first linear axis;

means for mounting a plurality of contacts along the first linear axis of the frame;

means for mounting a plurality of connectors to the frame along a second linear axis parallel to the first linear axis, the means for mounting the connectors being adapted to connect the connectors to the frame spaced from, but aligned with the contacts to face the same direction as the contacts, and comprising a first snap-lock connecting system, wherein contact pads on the edge of the printed circuit board can be positioned in the receiving area to contact the contacts and, contacts extending from the printed circuit board can be connected to the connectors; and means for mounting the frame to an electrical component chassis comprising a second snap-lock connecting system.

8. A housing as in claim 7 wherein the means for mounting a plurality of contacts comprises means for inserting the contacts through a rear end of the frame at a slot in the frame for receiving an edge of a printed circuit board.

9. A housing as in claim 7 wherein the means for mounting a plurality of connectors comprises means for inserting the connectors through a rear end of the frame into receiving areas of the frame.

10. An electrical connector nesting frame comprising:

means for snap-lock mounting the frame to an electrical component chassis; and means for snap-lock mounting a connector of a flexible circuit assembly to the frame, the means for mounting the connector to the frame comprising a receiving hole in the frame with side ribs adapted to be received in side notches of the connector and a cantilevered spring latch adapted to project behind a portion of the connector, and means for allowing limited lateral movement of the connector relative to the frame.

11. A nesting frame as in claim 10 wherein the means for snap-lock mounting the frame to an electrical component chassis comprises ledges on opposite sides of the frame.

12. A nesting frame as in claim 10 further comprising means for positioning an edge of a printed circuit board adjacent the connector.

13. A method of assembling an electrical connector assembly in an electronic component comprising steps of:

providing a single elongate modular connector nesting frame, the frame having a card edge receiving area and connector receiving areas;

connector the frame to a chassis of the electronic component, the step of connecting comprising making a snap-lock connection of the frame to the electronic component;

connecting first connectors of at least two flexible circuit assemblies to the frame, the step of connecting first connectors comprising making snap-lock connections of the connectors to the frame at different locations along the frame in the connector receiving areas such that the frame can be connected to the chassis and the flexible circuit assemblies can be connected to the frame to allow easier connection of the frame and assemblies as a stepped process; and connecting spring contacts to the frame at the card edge receiving area such that the assembly can also function as a card edge connector.

14. A method as in claim 13 wherein the step of connecting the first connectors to the frame comprises inserting the connectors through a rear end of the frame into receiving holes.

* * * * *